US005997338A

United States Patent [19]

Pohjola

[11] Patent Number: 5,997,338

[45] **Date of Patent: *Dec. 7, 1999**

[54] CONDUCTOR JOINT FOR CONNECTING AN INTELLIGENT SOCKET TO A CABLE

[75] Inventor: Jorma Pohjola, Varjakka, Finland

[73] Assignee: Oy IWS International Inc., Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/648,013

[22] PCT Filed: Dec. 1, 1994

[86] PCT No.: PCT/FI94/00542

§ 371 Date: May 30, 1996

§ 102(e) Date: May 30, 1996

[87] PCT Pub. No.: WO95/15594

PCT Pub. Date: Jun. 8, 1995

[30] Foreign Application Priority Data

Dec. 1, 1993 [FI] Finland ..... 935373

[51] Int. Cl.[6] ..... H01R 13/62; H01R 29/00

[52] U.S. Cl. ..... 439/425; 439/52

[58] Field of Search ..... 439/419, 415, 439/422, 425, 52

[56] References Cited

U.S. PATENT DOCUMENTS

| | | | |
|---|---|---|---|
| 2,745,078 | 5/1956 | Wood, Jr. | 439/425 |
| 3,213,404 | 10/1965 | Hedstrom | 439/425 |
| 3,713,072 | 1/1973 | Henschen et al. | 439/425 |
| 4,259,778 | 4/1981 | Greenwood | 29/560 |
| 4,941,843 | 7/1990 | Block et al. | 439/425 |
| 5,044,964 | 9/1991 | Minerd et al. | 439/67 |
| 5,368,490 | 11/1994 | McKissick | 439/52 |

FOREIGN PATENT DOCUMENTS

| | | |
|---|---|---|
| 0 323 340 | 7/1989 | European Pat. Off. . |
| 2 409 311 | 12/1974 | Germany . |
| 25 07 130 | 4/1976 | Germany . |
| 39 20 367 | 1/1991 | Germany . |
| 41 41 738 | 6/1993 | Germany . |
| 662 906 | 10/1987 | Switzerland . |
| 93/10591 | 5/1993 | WIPO . |
| 93/12560 | 6/1993 | WIPO . |

*Primary Examiner*—Hien Vu
*Attorney, Agent, or Firm*—Thelen Reid & Priest

[57] ABSTRACT

A connector joint is shown for use in effecting a galvanic joint with flat metal strip conductors surrounded by an insulating sheath for supplying or delivering electricity to an apparatus requiring electrical power, or for providing an electrical connection to an extension or branch wire. Pins are provided having sharp cutting ridges for piercing the insulating sheath and the flat metal strip conductors. Portions of the flat metal strip conductors form downwardly turned lips that press firmly against sides of the pins when the pins are assembled into the connector joint. A wire connector is electrically connected to said pins and a switch can be provided to control the flow of electricity from the flat metal strip conductors through the pins and to the wire connector.

5 Claims, 3 Drawing Sheets

CONDUCTOR JOINT FOR CONNECTING AN INTELLIGENT SOCKET TO A CABLE

BACKGROUND OF THE INVENTION

The present invention relates to a conductor joint, comprising a conductor or wire connector for providing a galvanic joint between the connector and flat metal-strip conductors surrounded by an insulating sheath. Such a conductor joint is used for the supply of electricity into a conductor or the delivery of electricity from a conductor or for a joint between conductors required in the branching or extension of a wire.

The invention relates also to a tool and a method for making a conductor joint.

A wire connector or a conductor joint of the invention is especially intended for use in a new type of electric harness included in vehicles, particularly in automobiles, for supplying power to signal lamps, headlights or other electrical equipment of a vehicle. However, the invention is not limited to any given application. Another exemplary application includes community lighting systems.

The electric harnesses of automobiles and vehicles in general have been traditionally designed in such a manner that separate wires extend to the service points like signal lamps and headlights through operating switches and fuses. All signal and warning lights are also provided with separate wires which extend between a power source transducer and a light source. A result of this is that the electric harnesses included in automobiles make up a labour-intensive and quite expensive element in an automobile. Another problem is the defect sensitivity of such electric harnesses, which is due to a large number of joints between conductors and various components as well as to the fact that the conductors have an enormous total length, causing a significant possibility of short circuits e.g. as a result of attrition. The locating of contact faults and short circuits and the mending of defects in such electric harnesses is a tedious process.

International Patent application WO93/10591 discloses an improved system, wherein the signal lamps and other such electrically operated items are connected in parallel to one or just a few wires, whose conductor is provided with a code for the controlled operation of lamps and other such actuators. The lamp or the lamp socket is provided with necessary electronics for identifying an operation control code intended for a relevant lamp or some other actuator. This system is capable of substantially simplifying an automobile electric harness for essentially reduced total costs and susceptibility to defects.

SUMMARY OF THE INVENTION

An object of this invention is to provide a novel type of wire connector or conductor joint, which is especially suitable for use in a wiring system the same as or similar to the wiring system disclosed in the cited Patent publication WO 93/10591 in a manner that the contact faults can be practically eliminated from conductor joints.

A further object of the invention is to provide a wire connector, whose internal coding can be used for assigning various functions to signal lamps, which are even identical to each other or different only in terms of power ranges.

BRIEF DESCRIPTION OF THE DRAWING

The invention will now be described in more detail by means of exemplary embodiments with reference made to the accompanying drawings, in which.

DETAILED DESCRIPTION OF THE PREFERRED EMBODIMENTS

Figure 1:
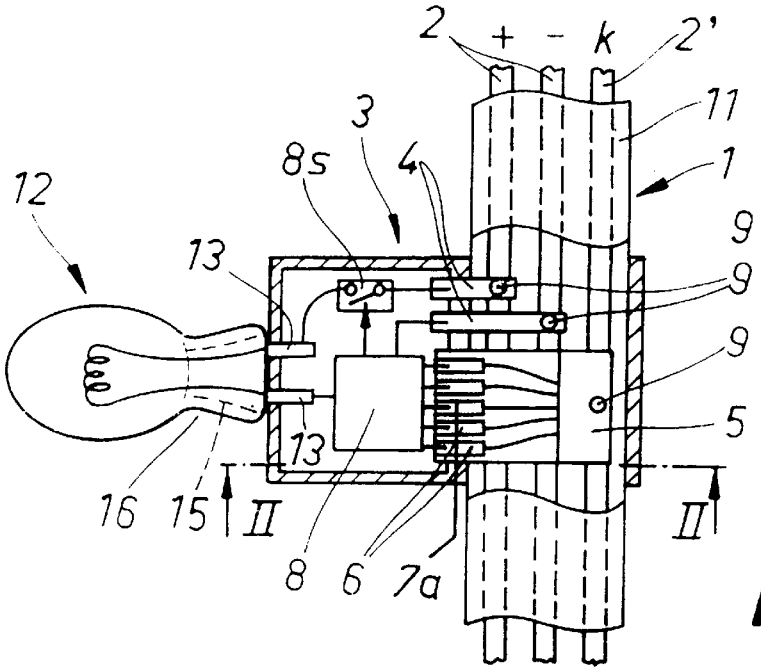
FIG. 1 shows a wire connector of the invention in a cut-away view (one half of the housing is omitted) when using the connector between a wire 1 and a lamp 12.
Figure 2:
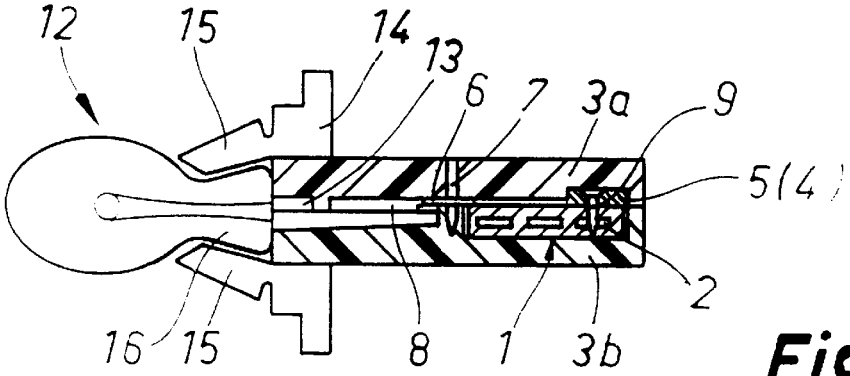
FIG. 2 shows the wire connector of FIG. 1 in a section along the line II—II in FIG. 1.

A wire connector of the invention is intended for use in making a galvanic joint between flat metal-strip conductors 2, surrounded by an insulating sheath 11, and electrical actuators, such as a signal lamp 12. This type of connector is shown in FIGS. 1 and 2. Alternatively, the connector is used for making a galvanic joint between metal-strip conductors 2 included in two different wires 1 and 2*a*.

The connector may or may not include an intelligent component described in more detail hereinbelow.

In the illustrated case, the conductors 2 included in a wire 1 are connected to the+ and– terminals of a power source and a conductor 2' serves as a code conductor for providing an identification code, on the basis of which the ON/OFF-switching of a lamp 12 or some other actuator is effected. Naturally, the code and current may also travel in one and the same conductor and, thus, a separate code conductor is not necessary. The supply of current from the conductors 2 to the connector is effected by way of conductor strips 4. One conductor strip 4 is connected by way of a semiconductor switch 8*s* to one terminal 13 of the lamp 12. The other conductor strip 4 is connected by way of an electronic component 8 to the other lamp terminal 13'. The electronic component 8 is provided with necessary circuit elements for regulating the power passing through the lamp 12. In addition, the electronic component 8 provides the switch 8*s* with an ON/OFF-control whenever it recognizes an identification code, intended for a particular connector 3 and received from the code conductor 2' which can also be replaced by a current conductor. The code conductor 2' is connected to the electronic component 8 by means of a plurality of parallelconnected connecting strips 6. The conductor strips 6 can be optionally cut along a line 7*a*. Depending on which conductor strips 6 are cut, it is possible to have signal lamps 12, which are e.g. identical or just provided with a different power range, operate in a different manner for a given application, e.g. as a blinker, a taillight, a parking light, reverse light or the like. Thus, the coding performed by cutting the strips 6 is in correlation with the location of each lamp 12 and an intended application pertinent thereto. This coding can be effected e.g. with a sharp-pointed tool by "nailing". In view of this nailing, the connector housing includes a top housing section 3*a* (FIG. 2) which is provided with necessary holes 7 or sharp-pointed pins are set ready in these holes. Most preferably, this nailing can be effected by using available multi-pointed tools, wherein the desired points can be extended to a cutting depth. In a tool, those pins provided with a cutting point can be shiftable in such a manner that, according to a desired coding, any pins can be shifted to or from a cutting position. With such a tool, even identical conductor connectors 3 can be converted to match the intended application thereof.

The cutable coding strips 6 can be replaced with relays or switches, certain ones of which can be activated or inactivated previously such that the code is only able to pass through some of the parallel-connected relays or switches.

An essential feature regarding the operation and operating reliability of such a connector is to secure a trouble-free and long-sustained galvanic contact between the conductors 2, 2' and the conductor strips 4, 6. Therefore, the conductor strips 4 and 5 are provided with special connector pins 9, whose points are sharpened such that the plastic sheath 11 and conductors 2 of the wire 1 can be pierced while the top housing section 3*a*, which is fitted with said connecting strips 4, 5, 6, is turned or pressed into position against a bottom housing half 3*b*. The housing halves 3*a* and 3*b* can be fastened to each other e.g. by means of self-locking snap fits.

Figure 5:
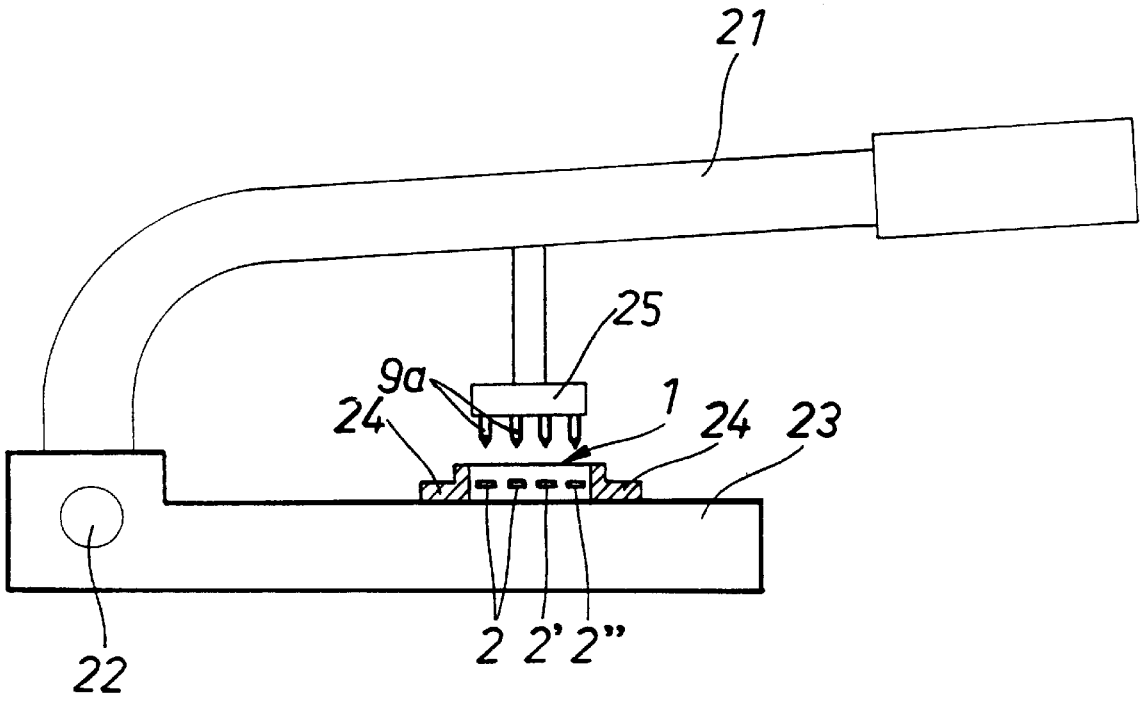
FIG. 5 shows a tool for using an alternative wire connector of the invention or for making a conductor joint.

Alternatively, it is possible to use a special tool (FIG. 5) provided with perforating pins 9*a*, corresponding to the connector pins 9 but having slightly smaller diameters and used for making preliminary perforations in the conductors 2. Thus, the points of the actual connector pins 9 need not be sharpended for piercing. In the exemplary case of FIG. 5, a pre-perforation tool 25 is fastened to a shaft 21 which is capable of pivoting around a link 22. A perforation tool table 23 is provided with guides 24 for receiving a wire 1. The shaft 21 can be pressed downwards for making preliminary perforations in the conductors 2, whereby the connection of a wire can be effected with a lesser force with a structurally weaker connector, possibly containing electronic components. When the pins included in the actual connector are shorter and round-tipped, there is no hazard for the pins to penetrate through the connector housing.

Neither need the connector be provided with a prefabricated housing but, instead, the connector area can be sealed hermetically with adhesive, resin or a like paste.

Figure 3:
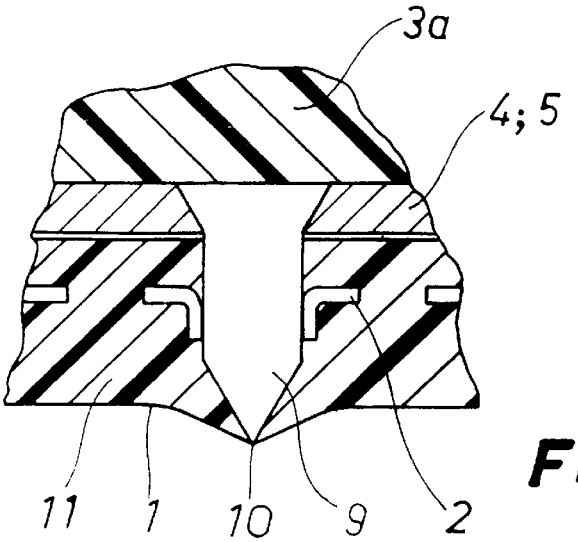
FIG. 3 shows an enlarged detail included in the connector of FIG. 2 at a connector pin 9 extending through a conductor 2.
Figure 3A:
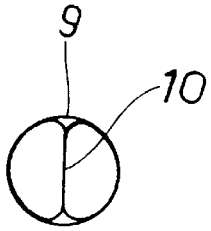
FIG. 3A shows a sharpened point 10 included in the connector pin 9 and viewed in the direction of the pin.

The tips of pins 9 or 9*a* (included in the connector or a separate tool) are designed as sharp points in view of providing an elongated cutting ridge 10 whose direction corresponds essentially to the longitudinal direction of the conductors. Thus, this direction is transversal relative to the direction of rolling. In this context, the direction of rolling refers to the direction in which most of the deformation occurs as the conductor is rolled from round to flat. As the conductor is flattening, the deformation in lateral direction exceeds that occurring in the longitudinal direction. Thus, the piercing of a conductor 2 proceeds in such a manner that in the mid-section of a conductor is first provided with an elongated incision having a length almost equal to the pin diameter, the conductor sections on either side of said incision turning downwards and pressing firmly against the sides of the pin 9 (or 9*a*), as shown in fig.3. This produces between the pins 9 and the conductor 2 a contact with a large surface area and a continuous prestress. In order to provide a lip as smooth as possible, the cutting ridge 10 has a length which is slightly less than the diameter of the pin 9 (or 9*a*). If the preliminary perforations are made by using the sharp-pointed pins 9*a*, the edges of a hole produced in the conductor 2 will have a matching shape and, thus, the contact is guaranteed both by the slightly larger diameter of the connector pins 9 and by the elasticity of an insulating material which compresses the edges of a hole in the conductor 2 around the pin 9. Since the piercing pin 9*a* included in the tool is similar to the pin 9 shown in FIG. 3, it has not been especially illustrated. It may be preferable that the pin 9 or 9*a* does not pierce the insulating sheath on the other side of the conductor, whereby the joint will have fewer points to be sealed.

Extending from the lamp 12 are two pins 13 and 13' which are insertable in slots included in the wire connector 3. The connector housing 3 may be provided with a special socket element 14 for securing the lamp 12 along with its connector in a fixing hole at the point of service. Extending from the socket element 14 or elsewhere from the connector housing 3 are flexible tongues 15 which take hold of the opposite sides of the lamp 12 at its reduced neck portion 16 for immobilizing the lamp 12 in the connector 3, which in the illustrated case provides an intelligent fastening socket for the lamp 12. Instead of a lamp 12, the connector 3 can be fitted e.g. with a contact plug, including a conductor for transmitting an electrical contact to a lamp or an actuator located further away from the connector. Also the intelligent connecting socket of a lamp can be located away from the connector 3.

Figure 4A:
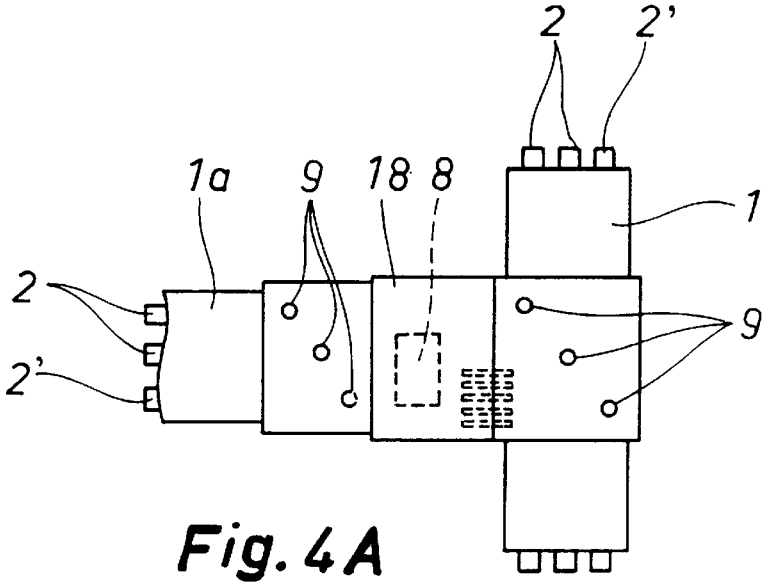
FIGS. 4 and 4A illustrate alternative connector embodiments intended for wire branching operations.
Figure 4B:
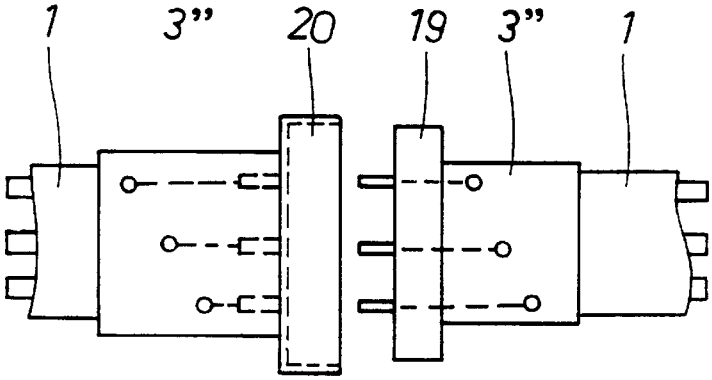
FIG. 4B shows the application of a connector of the invention in a disconnectable extension connector.
Figure 4:
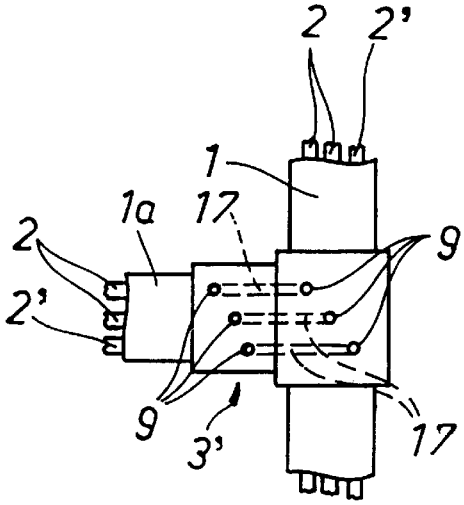

In the exemplary embodiment of FIG. 4, a connector of the invention is used in wire branching. A connector housing 3' 20 includes two sets of pins 9, which are connected to each other by means of conductors 17 included in the connector 3' as integral components. Between the housing halves said connector housing is provided with suitable receiving slots for a wire 1 to be branched and for a branch wire 1*a*. When the housing halves (corresponding to housing halves 3*a* and 3*b*) are pressed against each other, the pins 9 penetrate through the flat conductors 2 and 2' for providing a permanent contact between the conductors included in wires 1 and la. Thus, this embodiment does not have an electronic component included in the connector 3' or a possibility of internal coding, as in the embodiment of FIGS. 1 and 2. However, it is possible to build an intelligent component also in a connector used in wire branchings, as designated at 18 in FIG. 4A. Thus, the wire branch 1*a* is only supplied with electricity as determined by a control code.

FIG. 4B illustrates yet another embodiment for a connector of the invention. Here, the disconnectable wire joint comprises socket heads 19, 20, each of which is separately connected to a wire 1 by means of a connector 3" of the invention.

I claim:

1. A conductor joint for connecting an intelligent socket to a cable, the conductor joint comprising:

a) at least one current conductor that conducts electrical current;

b) a code conductor that carries an identification code;

c) an insulating sheath surrounding the at least one current conductor and the code conductor;

d) at least first and second pins, extending through the insulating sheath to pass through one of the at least one current conductor and through the code conductor, respectively, to form respective electrical connections in which portions of the at least one current conductor and code conductor form respective lips that press firmly against sides of the respective first and second pins;

e) an electronic component, responsive to the identification code when the identification code is carried on the code conductor, for providing a switch with an ON/OFF control; and f) the switch, responsive to the ON/OFF control, for controllably connecting one of the at least one current conductor to the intelligent socket, the switch including:

f1) an output serving as an output of the intelligent socket;

f2) a current input that is electrically connected to the first pin; and f3) a control input, responsive to the ON/OFF control, for causing the switch to transmit electrical current from one of the at least one current conductor through the first pin and the current input to the output of the intelligent socket.

2. The conductor joint of claim 1, further comprising:

a first conductor strip, extending between the switch and the first pin.

3. The conductor joint of claim 1, further comprising:

a second conductor strip, extending between the electronic component and the second pin.

4. The conductor joint of claim 1, further comprising:

a first conductor strip, extending between the switch and the first pin; and a second conductor strip, extending between the electronic component and the second pin.

5. The conductor joint of claim 1, further comprising:

the intelligent socket, for directly receiving an appliance.

* * * * *